US012575617B2

(12) United States Patent
Waters et al.

(10) Patent No.: US 12,575,617 B2
(45) Date of Patent: Mar. 17, 2026

(54) BACK TO FRONT REVERSIBLE GARMENT

(71) Applicant: LULULEMON ATHLETICA CANADA INC., Vancouver (CA)

(72) Inventors: Jessica May Waters, Vancouver (CA); Clare Maree Robertson, North Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 211 days.

(21) Appl. No.: 18/521,744

(22) Filed: Nov. 28, 2023

(65) Prior Publication Data

US 2024/0172811 A1 May 30, 2024

Related U.S. Application Data

(60) Provisional application No. 63/429,088, filed on Nov. 30, 2022.

(51) Int. Cl.
*A41C 3/00* (2006.01)
*A41C 3/10* (2006.01)

(52) U.S. Cl.
CPC ..... *A41C 3/0028* (2013.01); *A41C 3/0035* (2013.01); *A41C 3/10* (2013.01)

(58) Field of Classification Search
CPC ..... A41C 3/0028; A41C 3/0035; A41C 3/10
See application file for complete search history.

(56) References Cited

U.S. PATENT DOCUMENTS

| | | | | |
|---|---|---|---|---|
| 7,396,272 | B1 * | 7/2008 | Newlen | A41C 3/0064 450/36 |
| 2010/0199403 | A1 * | 8/2010 | Greenblat | A41D 15/005 2/69 |
| 2013/0217304 | A1 * | 8/2013 | Bailey | A41C 3/0028 450/55 |
| 2014/0317823 | A1 * | 10/2014 | Hanson | A41D 15/005 2/243.1 |
| 2014/0352026 | A1 * | 12/2014 | Ruth Ann | A41D 27/02 2/69 |
| 2014/0364037 | A1 * | 12/2014 | Bailey | A41C 3/0028 450/58 |
| 2020/0128889 | A1 * | 4/2020 | Torano | A41B 9/00 |
| 2021/0106085 | A1 * | 4/2021 | Ann | A41D 15/007 |
| 2022/0408865 | A1 * | 12/2022 | Zabawa | A41D 31/185 |
| 2024/0172811 | A1 * | 5/2024 | Waters | A41C 3/0028 |

* cited by examiner

*Primary Examiner* — Gloria M Hale

(57) ABSTRACT

A back to front reversible garment system is provided. The garment system includes a first portion, a second portion, the first and second portions connected together at their sides, and each having an outer layer and an inner layer defining at least one pocket therebetween with at least one pocket entrance opening. The garment system also includes at least one padded insert that is positioned in the pocket of either the first portion or the second portion. The garment system is wearable in either a first position or a second position. In the first position, the first portion covers at least a portion of a wearer's chest and the second portion covers at least a portion of the wearer's back. In the second position, the second portion covers at least a portion of the wearer's chest and the first portion covers at least a portion of the wearer's back.

20 Claims, 6 Drawing Sheets

BACK TO FRONT REVERSIBLE GARMENT

FIELD OF INVENTION

This invention relates to reversible garments, and more particularly, to back to front reversible garments that cover at least a portion of a wearer's back and chest.

BACKGROUND OF THE INVENTION

Most garments are constructed with a single way of being worn by a wearer. For example, a bra has a front to cover at least a portion of a chest of the wearer and a back to cover at least a portion of a back of the wearer. A back to front reversible garment provides different looks, silhouettes, coverage, textures or washes on first and second presentations of the garment. The first presentation provides a first visual appearance and the second presentation provides a second visual appearance using the same garment. Thus, back to front reversible garments provide a way for wearers to diversify their wardrobe without obtaining separate sets of clothing.

While there are various types of known back to front reversible garments, there are some limitations and disadvantages associated therewith. For example, for back to front reversible garments that cover at least a portion of a wearer's chest area, the garment is uncomfortable for the wearer unless the garment also includes breast tissue padding and/or support.

Thus, there remains a need for back to front reversible garments where either side of the garment can cover at least a portion of the wearer's chest and still provide breast tissue padding, coverage and/or support.

SUMMARY OF THE INVENTION

In various embodiments, the present disclosure provides a back to front reversible garment.

In one aspect, the present disclosure provides a front to back reversible garment system comprising: a first portion comprising an outer layer, an inner layer, a first side and a second side, the outer layer and the inner layer defining at least one first portion pocket therebetween with at least one first portion pocket entrance opening, the first portion operably configured to cover at least a portion of a wearer's chest or to cover at least a portion of the wearer's back, and the first portion defining two arm-opening edges; a second portion comprising an outer layer, an inner layer, a first side and a second side, the outer layer and the inner layer defining at least one second portion pocket therebetween with at least one second portion pocket entrance opening, the second portion operably configured to cover at least a portion of the wearer's chest or to cover at least a portion of the wearer's back, and the second portion defining two arm-opening edges, wherein the first side of the second portion is connected to the second side of the first portion, and the second side of the second portion is connected to the first side of the first portion; and at least one padded insert operably configured to be inserted through the at least one first portion pocket entrance opening and positioned in the at least one first portion pocket and to be inserted through the at least one second portion pocket entrance opening and positioned in the at least one second portion pocket, wherein in a first position on the wearer, the first portion covers at least the portion of the wearer's chest and the second portion covers at least the portion of the wearer's back, and the at least one padded insert is positioned in the at least one first portion pocket, and wherein in a second position on the wearer, the second portion covers at least the portion of the wearer's chest and the first portion covers at least the portion of the wearer's back, and the at least one padded insert is positioned in the at least one second portion pocket.

In various embodiments, the first portion further comprises two or more first connector parts of a two-part connector, the second portion further comprises two or more first connector parts of the two-part connector and the at least one padded insert further comprises two or more second connector parts of the two-part connector, wherein in the first position on the wearer, the two or more first connector parts of the first portion are connected to the respective two or more second connector parts of the at least one padded insert, and wherein in the second position on the wearer, the two or more first connector parts of the second portion are connected to the respective two or more second connector parts of the at least one padded insert.

In various embodiments, the at least one first portion pocket entrance opening comprises first and second openings, the first opening proximate the first side of the first portion and the second opening proximate the second side of the first portion.

In various embodiments, the at least one second portion pocket entrance opening comprises first and second openings, the first opening proximate the first side of the second portion and the second opening proximate the second side of the second portion.

In various embodiments, the at least one first portion pocket entrance opening is formed at a part of a top edge of the first portion, and the at least one second portion pocket entrance opening is formed at a part of a top edge of the second portion.

In various embodiments, the at least one first portion pocket entrance opening is formed at one or both of the two arm-opening edges of the first portion, and the at least one second portion pocket entrance opening is formed at one or both of the two arm-opening edges of the second portion.

In various embodiments, the back to front reversible garment system further comprises one or more shoulder straps connecting the first portion and the second portion.

In various embodiments, the at least one padded insert is a single piece insert pad. In various embodiments, the at least one first portion pocket is a single pocket and the at least one second portion pocket is a single pocket.

In various embodiments, the at least one padded insert is a single piece insert pad comprising two or more second connector parts spaced apart and located at an outer edge of the single piece insert pad, the two or more first connector parts of the first portion and of the second portion are spaced apart and located in proximity to an outer margin of the respective at least one first portion pocket or the at least one second portion pocket such that when the single piece insert pad is positioned in one of the at least one first portion pocket or the at least one second portion pocket, the two or more second connector parts of the single piece insert pad are connected to the respective two or more first connector parts of the first portion or the second portion. For example, the two or more second connector parts may be on opposite sides of the single piece insert pad.

In various embodiments, the at least one padded insert is two padded inserts, each of the two padded inserts comprising two or more second connector parts spaced apart and located at an outer edge of each of the two padded inserts, the first portion and the second portion comprising a corresponding number of two or more first connector parts to connect with the respective second connector parts of the two padded inserts when such padded inserts are positioned in the at least one first portion pocket or the least one second portion pocket. For example, the two or more second connector parts may be on opposite sides of each of the two padded inserts. In various embodiments, the at least one first portion pocket is two pockets and the at least one second portion pocket is two pockets.

In various embodiments, the front to back reversible garment further comprises two or more arms extending from the at least one padded insert, each of the second connector parts located at a distal end of one of the two or more arms.

In various embodiments, each of the first portion and the second portion comprise the same number of first connector parts as the total number of second connector parts on the at least one padded insert.

In various embodiments, the two-part connector is a hook and loop fastener, a hook and eye fastener, a snap fastener, a button and loop fastener, a clasp and hook fastener, a buckle, or a frog fastener.

In various embodiments, each of the two or more first connector parts of the first portion are adjacent to the two arm-opening edges of the first portion, and each of the two or more first connector parts of the second portion are adjacent to the two arm-opening edges of the second portion.

In various embodiments, the garment is a bra, a swimsuit or a tank top.

In various embodiments, a shape of the first portion is different from a shape of the second portion.

In various embodiments, a shape of the single piece insert pad comprises a reduced diameter at a centre line of the single piece insert pad.

In various embodiments, a shape of the at least one padded insert matches a breast profile shape of the wearer.

In various embodiments, the back to front reversible garment system further comprises an underband connected to a bottom edge of the first portion and a bottom edge of the second portion.

In various embodiments, the connection between the first side of the second portion and the second side of the first portion comprises a seam or is seamless, and the connection between the second side of the second portion and the first side of the first portion comprises a seam or is seamless.

In addition to the aspects and embodiments describe above, further aspects and embodiments will become apparent by reference to the drawings.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

DETAILED DESCRIPTION

Figure 1:
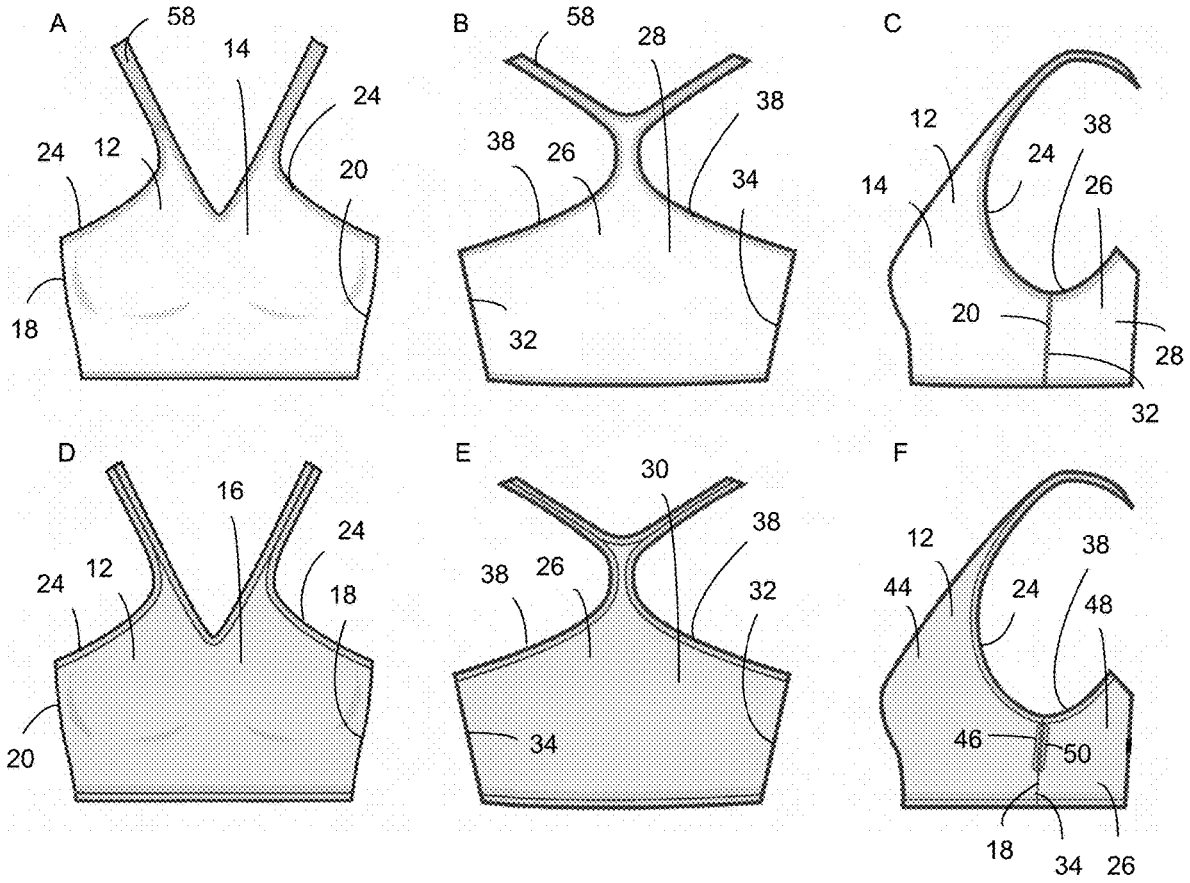
FIG. 1 is a front view of an outer layer of a first portion (A), a front view of an outer layer of a second portion (B), a side view of the outer layer of the first portion and the outer layer of the second portion connected together (C), a front view of an inner layer of the first portion (D), a front view of an inner layer of the second portion (E) and a side view of the inner layer of the first portion and the inner layer of the second portion connected together (F) of a front to back reversible garment system according to an embodiment of the disclosure.

In the following description, details are set forth to provide an understanding of the application. In some instances, certain structures, techniques, and methods have not been described or shown in detail in order not to obscure the application.

In the context of the present disclosure, various terms are used in accordance with what is understood to be the ordinary meaning of those terms.

Directional terms such as "top", "bottom", "front", "back", "upper", "lower", "outer" and "inner" are used in the following description for the purpose of providing relative reference only, and are not intended to suggest any limitations on how any article or garment is to be positioned during use, or to be mounted in an assembly or relative to an environment. The use of the word "a" or "an" when used herein in conjunction with the term "comprising" may mean "one", but it is also consistent with the meaning of "one or more", "at least one" and "one or more than one".

Any element expressed in the singular form also encompasses its plural form. Any element expressed in the plural form also encompasses its singular form. The term "plurality" as used herein means more than one, for example, two or more, three or more, four or more, and the like.

The present disclosure provides a back to front reversible garment. The back to front reversible garment may be worn by a wearer in either of two ways, the garment including one or more padded inserts that can be used to provide coverage, padding and/or support to breast tissue of the wearer in either position. Thus, the garment provides comfort and aesthetics for the wearer.

Referring to FIGS. 1A-1B, 5A-5B and 7A-7B, and according to a first embodiment of the disclosure, a back to front reversible garment system is shown. The reversible garment comprises a first portion 12 comprising an outer layer 14, an inner layer 16, a first side 18, a second side 20, the outer layer 14 and the inner layer 16 defining at least one first portion pocket therebetween with at least one first portion pocket entrance opening 46, and defines two arm-opening edges 24. In various embodiments, the at least one first portion pocket entrance opening 46 may be defined by and accessible from the inner layer 16 of the first portion 12. The first portion 12 covers at least a portion of a wearer's chest or at least a portion of the wearer's back. In various embodiments, the first portion 12 may comprise additional layers so long as the at least one first portion pocket is defined. In various embodiments, the outer layer 14 and the inner layer 16 may be sewn or bonded together along various seams or edges, or on various other parts of the first portion 12, as described in further detail below.

The reversible garment 10 also comprises a second portion 26. The second portion 26 comprises an outer layer 28, an inner layer 30, a first side 32, a second side 34, the outer layer 28 and the inner layer 30 defining at least one second portion pocket therebetween with at least one second portion pocket entrance opening 50, and defines two arm-opening edges 38. In various embodiments, the at least one second portion pocket entrance opening 50 may be defined by and accessible from the inner layer 30 of the second portion 26. The second portion 26 covers at least a portion of a wearer's chest or at least a portion of the wearer's back. In various embodiments, the second portion 26 may comprise additional layers so long as the at least one second portion pocket is defined. In various embodiments, the outer layer 28 and the inner layer 30 may be sewn or bonded together along various seams or edges, or on various other parts of the second portion 26, as described in further detail below.

The first side 32 of the second portion 26 is connected to the second side 20 of the first portion 12 and the second side 34 of the second portion 26 is connected to the first side 18 of the first portion 12, as shown in FIGS. 1C, 1F, 4, 5C, 5F, 7B and 7E. In various embodiments, the connection between the first side 32 of the second portion 26 and the second side 20 of the first portion 12 comprises a seam or is seamless. The connection between the second side 34 of the second portion 26 and the first side 18 of the first portion 12 may also comprise a seam or be seamless.

Figure 5:
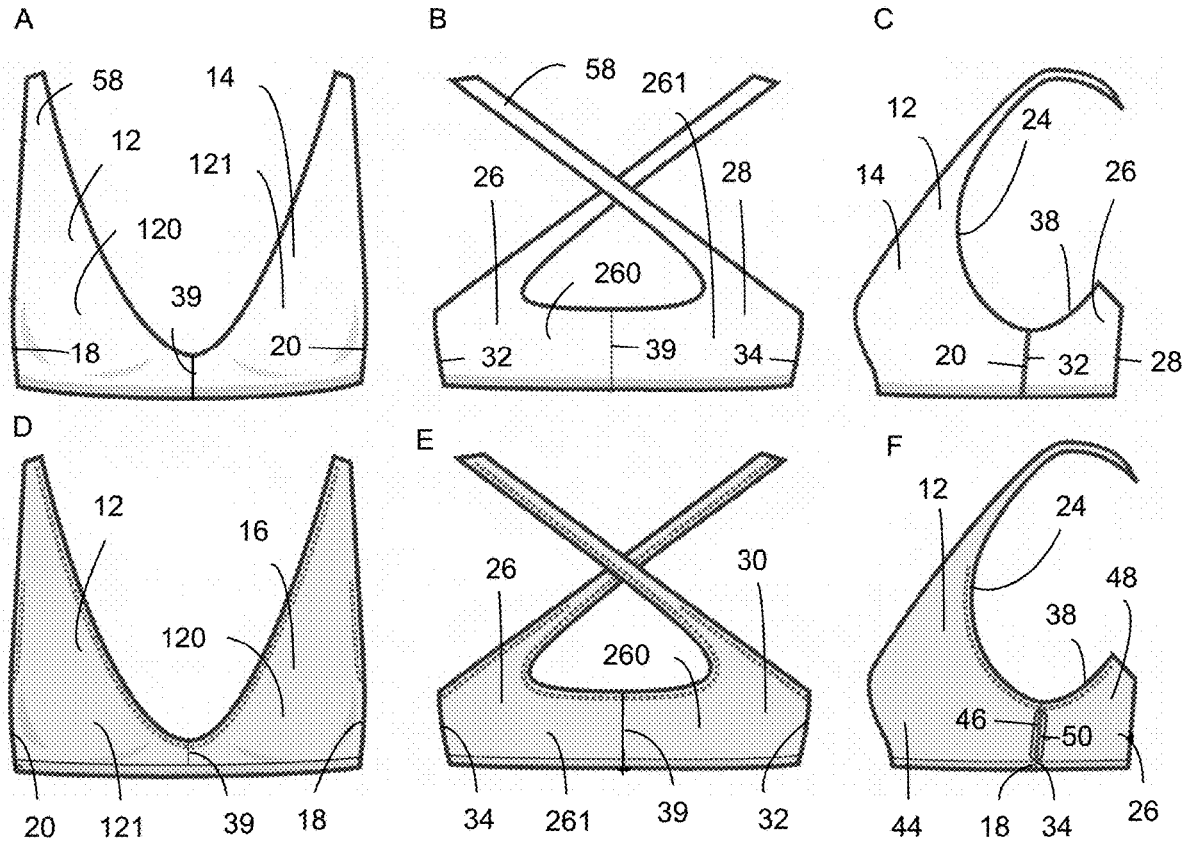
FIG. 5 is a front view of an outer layer of a first portion (A), a front view of an outer layer of a second portion (B), a side view of the outer layer of the first portion and the outer layer of the second portion connected together (C), a front view of an inner layer of the first portion (D), a front view of an inner layer of the second portion (E) and a side view of the inner layer of the first portion and the inner layer of the second portion connected together (F) of a front to back reversible garment system according to a further embodiment of the disclosure.
Figure 7:
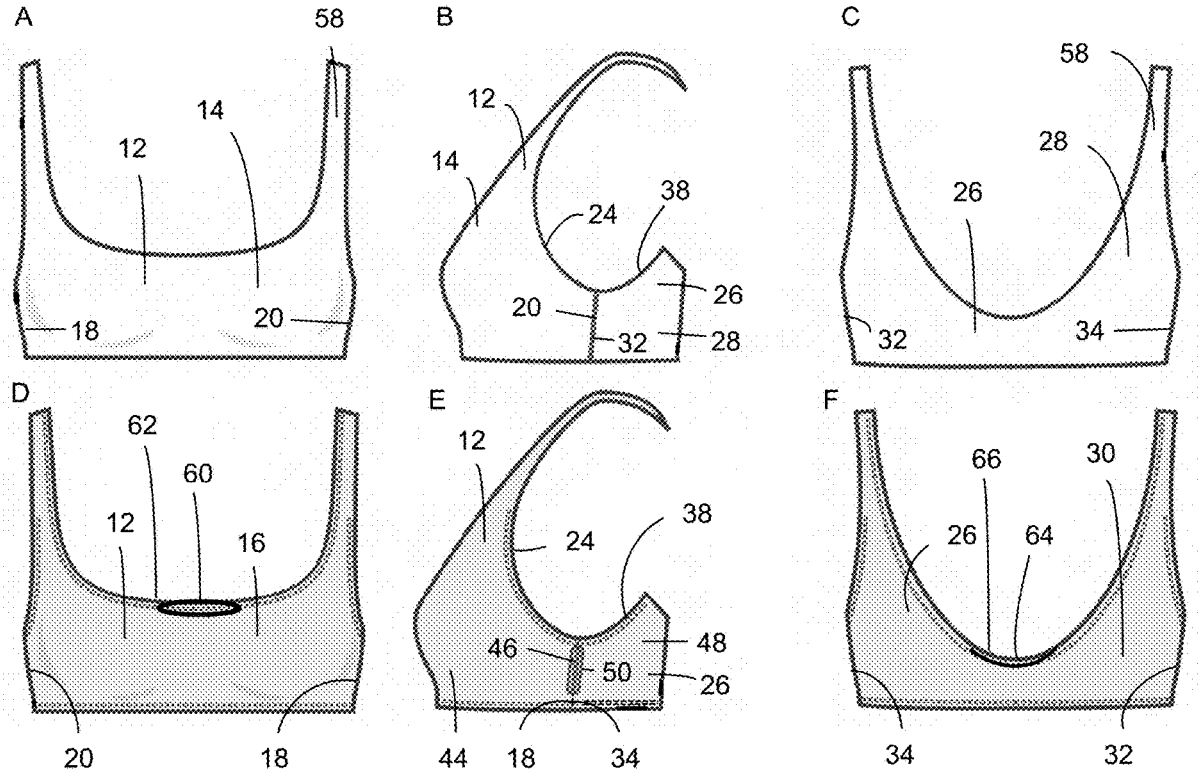
FIG. 7 is a front view of an outer layer of a first portion (A), a side view of the outer layer of the first portion and an outer layer of a second portion connected together (B), a front view of the outer layer of the second portion (C), a front view of an inner layer of the first portion (D), a side view of the inner layer of the first portion and an inner layer of a second portion connected together (E), and a front view of the inner layer of the second portion (F) of a front to back reversible garment system according to a further embodiment of the disclosure.

In various embodiments, a shape of the first portion 12 may be different to a shape of the second portion 26, thereby providing different "looks" to the wearer of the back to front reversible garment. Different shapes for the first portion 12 and the second portion 26 are shown in FIGS. 1, 5 and 7.

Figure 2:
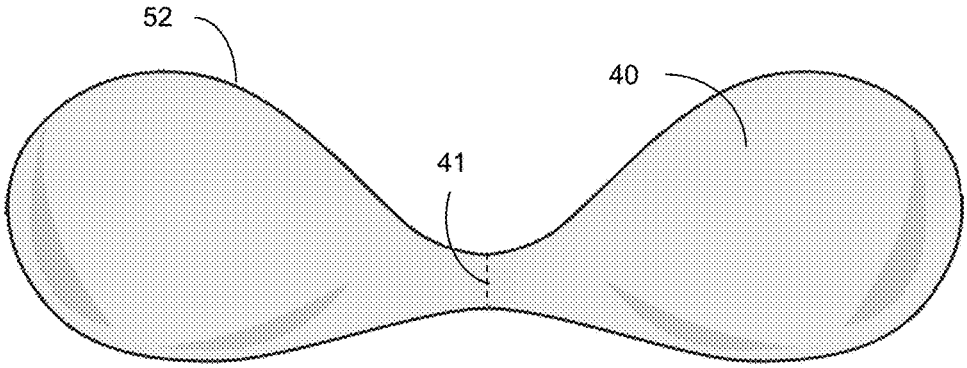
FIG. 2 is a front view of a padded insert of a front to back reversible garment system according to an embodiment of the disclosure.

As shown in FIG. 2, the back to front reversible garment system also comprises at least one padded insert 40. The at least one padded insert 40 is for insertion through either the at least one first portion pocket entrance opening 46 or the at least one second portion pocket entrance opening 50. The at least one padded insert 40 is then positioned in either the at least one first portion pocket or the at least one second portion pocket, respectively. The at least one first portion pocket and the at least one second portion pocket are operably configured to contain the at least one padded insert 40 and hold the at least one padded insert 40 therein. The at least one padded insert 40 is positioned in the portion of the reversible garment system that is covering at least the portion of the wearer's chest, thereby providing coverage, padding and/or support to breast tissue of the wearer. In various embodiments, the at least one padded insert 40 is a single piece insert pad, as shown in FIG. 2. In such embodiments, the at least one first portion pocket may be a single pocket and the at least one second portion pocket may also be a single pocket. Alternatively, the at least one padded insert 40 includes two padded inserts. In such embodiments, the at least one first portion pocket may include one or two pockets and the at least one second portion pocket may include one or two pockets, as described in more detail below.

The shape of the at least one padded insert 40 may be of any shape that provides coverage, padding and/or support for breast tissue of the wearer. For example, the shape of the at least one padded insert 40 may match a breast profile shape of the wearer, as shown in FIG. 2. Alternatively or in addition, the shape of the at least one padded insert 40 may have a reduced diameter at a centre line 41 of the at least one padded insert 40, particularly in embodiments where the at least one padded insert 40 comprises a single piece insert pad, as also shown in FIG. 2.

Figure 4:
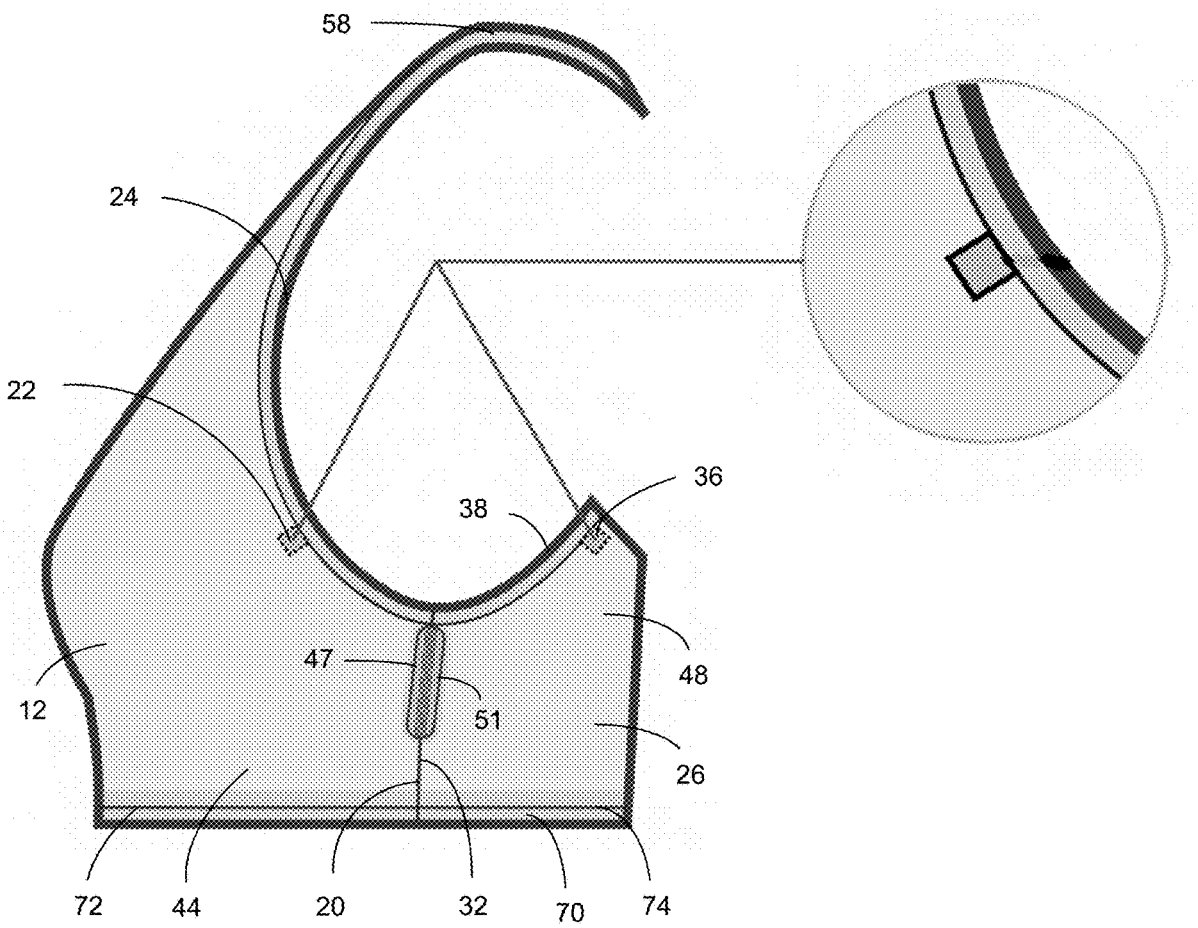
FIG. 4 is a side view of an inner layer of the first portion and an inner layer of the second portion of a front to back reversible garment system according to an embodiment of the disclosure.

In various embodiments, the at least one first portion pocket entrance opening 46 may comprise first and second openings. As shown in FIG. 4, the first opening (not shown) may be proximate the first side 18 of the first portion 12 and the second opening 47 proximate the second side 20 of the first portion 12. Likewise, the at least one second portion pocket entrance opening 50 may comprise first and second openings. As shown in FIG. 4, the first opening 51 may be proximate the first side 32 of the second portion 26 and the second opening (not shown) may be proximate the second side 34 of the second portion 26. Alternatively, the at least one first portion pocket entrance opening 46 may be formed at a part 60 of a top edge 62 of the first portion 12 and the at least one second portion pocket entrance opening 50 may be formed at a part 64 of a top edge 66 of the second portion 26, as shown in FIGS. 7D and 7F. In further embodiments, the at least one first portion pocket entrance opening 46 may be formed at one or both of the two arm-opening edges 24 of the first portion 12, and the at least one second portion pocket entrance opening 50 may be formed at one or both of the two arm-opening edges 38 of the second portion 26.

Figure 3:
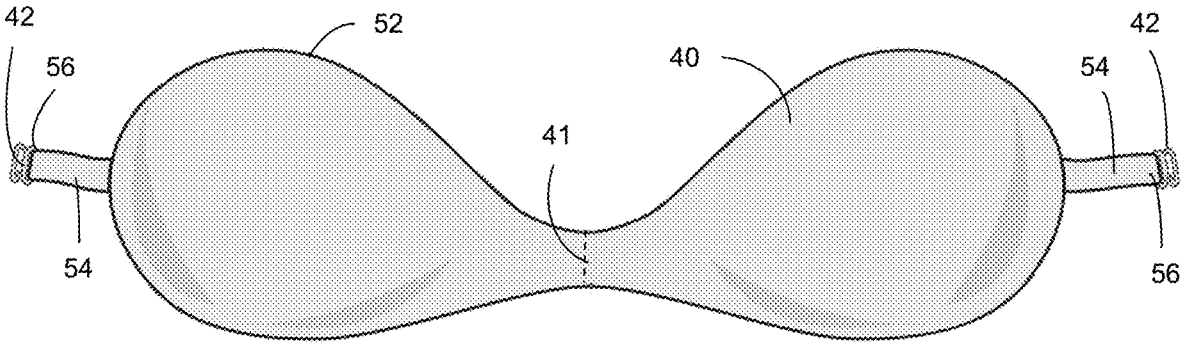
FIG. 3 is a front view of a padded insert of a front to back reversible garment system according to a further embodiment of the disclosure.

In various embodiments, the at least one first portion pocket may be a single pocket and the at least one second portion pocket may be a single pocket, as shown in FIGS. 1 and 7. Such embodiments may be suitable for use when the at least one padded insert 40 is a single piece insert pad or includes two padded inserts. For example, the at least one padded insert 40 shown in FIGS. 2 and 3 are suitable for use with the first portion 12 and the second portion 26 including one pocket each, such as, for example, the first portion 12 and the second portion 26 of FIGS. 1 and 7. The at least one first portion pocket entrance opening 46 and the at least one second portion pocket entrance opening 50 may be one opening or two openings, as described above.

In alternative embodiments, the at least one first portion pocket may be two pockets and/or the at least one second portion pocket may be two pockets. In these embodiments, the inner layer 16 and the outer layer 14 of the first portion 12, and the inner layer 30 and the outer layer 28 of the second portion 26, may be connected together to form a separating seam 39 which defines the two pockets, as shown in FIGS. 5A, 5B, 5D, 5E and 6B. The separating seam 39 may be sewn or bonded, and therefore, may or may not be visible on the first portion 12 and/or the second portion 26. Such embodiments are suitable for use when the at least one padded insert 40 is two padded inserts. Furthermore, the at least one first portion pocket entrance opening 46 and the at least one second portion pocket entrance opening 50 may be two openings, such that there is one at least one first portion pocket entrance opening 46 for each pocket and one at least second portion pocket entrance opening 50 for each pocket. For example, as shown in FIG. 5, the at least one first portion pocket entrance opening 46 may comprise first and second openings. The first opening (not shown) may be proximate the first side 18 of the first portion 12 and provide access to a first portion first pocket 120, and the second opening 46 may be proximate the second side 20 of the first portion 12 and provide access to a first portion second pocket 121. Likewise, the at least one second portion pocket entrance opening 50 may comprise first and second openings, with the first opening 50 proximate the first side 32 of the second portion 26 and provide access to a second portion first pocket 260 and the second opening (not shown) may be proximate the second side 34 of the second portion 26 and provide access to a second portion second pocket 261. In alternative embodiments, there may be more than one at least one first portion pocket entrance opening 46 for each pocket and more than one at least one second portion pocket entrance opening 50 for each pocket.

Figure 8:
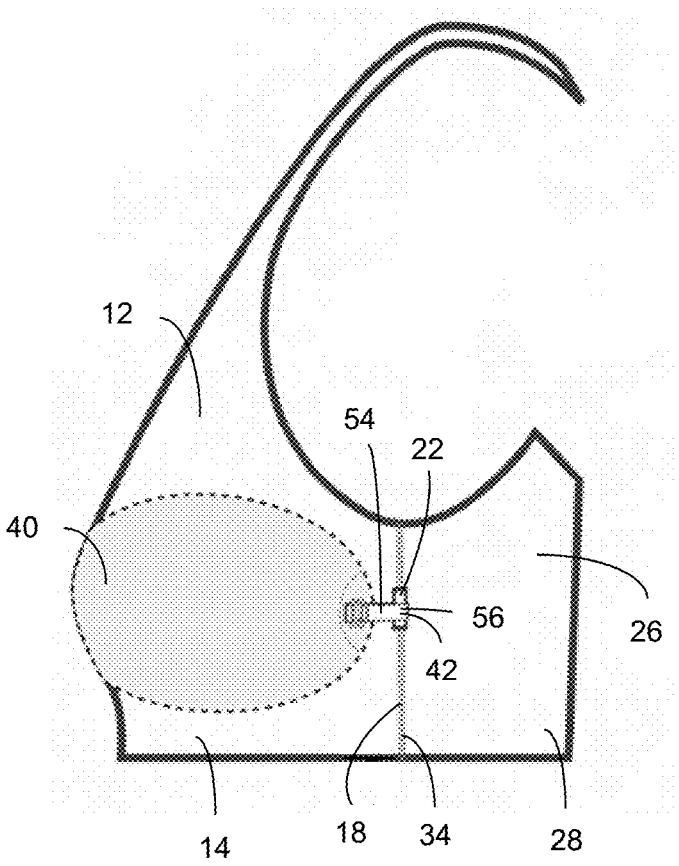
FIG. 8 is an interior side view of an outer layer of a first portion and an outer layer of a second portion showing at least one padded insert positioned in at least one first portion pocket of a front to back reversible garment system according to an embodiment of the disclosure.

The garment system may be worn by the wearer in either a first position or a second position, thus making the garment back to front reversible. In the first position on the wearer, and as shown in FIG. 8, the first portion 12 covers at least the portion of the wearer's chest and the second portion 26 covers at least the portion of the wearer's back. In other words, the first portion 12 is the front of the garment with the inner layer 16 of the first portion 12 facing the chest of the wearer, and the second portion 26 is the back of the garment with the inner layer 30 of the second portion 26 facing the back of the wearer. When worn in the first position, the at least one padded insert 40 is positioned in the at least one first portion pocket in order to provide coverage, padding and/or support to breast tissue of the wearer. The at least one padded insert 40 is held in position within the at least one first portion pocket.

In the second position on the wearer, the second portion 26 covers at least the portion of the wearer's chest and the first portion 12 covers at least the portion of the wearer's back. In other words, the second portion 26 is the front of the garment with the inner layer 30 of the second portion 26 facing the chest of the wearer, and the first portion 12 is the back of the garment with the inner layer 16 of the first portion 12 facing the back of the wearer. When worn in the second position, the at least one padded insert 40 is positioned in the at least one second portion pocket in order to provide coverage, padding and/or support to breast tissue of the wearer. The at least one padded insert 40 is held in position within the at least one second portion pocket.

As shown in FIGS. 3 and 4, in order to assist in holding the at least one padded insert 40 in position in either the at least one first portion pocket or the at least one second portion pocket, the back to front reversible garment system may further comprise a two-part connector, with two or more first connector parts 22 on the first portion 12, two or more first connector parts 36 on the second portion 26, and two or more second connector parts 42 on the at least one padded insert 40. When the reversible garment system is in the first position on the wearer, the two or more first connector parts 22 of the first portion 12 are connected to the respective two or more second connector parts 42 of the at least one padded insert 40. When the reversible garment system is in the second position on the wearer, the two or more first connector parts 36 of the second portion 26 are connected to the respective two or more second connector parts 42 of the at least one padded insert 40.

When the at least one padded insert 40 is positioned in the at least one first portion pocket, the two or more first connector parts 22 of the first portion 12 are adjacent to and abut corresponding second connector parts of the two or more second connector parts 42 on the at least one padded insert 40. When the at least one padded insert 40 is positioned in the at least one second portion pocket, the two or more first connector parts 36 of the second portion 26 are adjacent to and abut corresponding second connector parts of the two or more second connector parts 42 on the at least one padded insert 40.

The two or more first connector parts 22 may be positioned at a variety of locations on the first portion 12 within or exterior to the at least one first portion pocket, either on an inner side of the outer layer 14, on the inner layer 16, or a combination thereof. For example, each of the two or more first connector parts 22 of the first portion 12 may be adjacent to either of the two arm-opening edges 24 of the first portion 12, as shown in FIG. 4. In various embodiments, a same number of first connector parts 22 are located at each of the two arm-opening edges 24 of the first portion 12. Each of the two or more first connector parts 22 of the first portion 12 may also be adjacent to the first side 18 and/or the second side 20 of the first portion 12, as shown in FIG. 8.

The two or more first connector parts 36 may be positioned at a variety of locations on the second portion 26 within or exterior to the at least one second portion pocket, either on an inner side of the outer layer 28, on the inner layer 30, or a combination thereof. For example, each of the two or more first connector parts 36 of the second portion 26 may be adjacent either of the two arm-opening edges 38 of the second portion 26. In various embodiments, a same number of first connector parts 36 are located at each of the two arm-opening edges 38 of the second portion 26. Each of the two or more first connector parts 36 of the second portion 26 may also be adjacent to the first side 32 and/or the second side 34 of the second portion 26.

In various embodiments, each of the first portion 12 and the second portion 26 may comprise the same number of first connector parts 22 and 36, respectively, as the total number of second connector parts 42 on the at least one padded insert 40.

In various embodiments, the at least one padded insert 40 is a single piece insert pad comprising two or more second connector parts 42 spaced apart and located at an outer edge 52 of the single piece insert pad. For example, the two or more second connector parts 42 may be located on opposite sides of the single piece insert pad. The two or more first connector parts 22 of the first portion 12 and the two or more first connector parts 36 of the second portion 26 may be within the at least one first portion pocket and the at least one second portion pocket, respectively, and spaced apart and located in proximity to an outer margin of the respective at least one first portion pocket or the at least one second portion pocket, such that when the single piece insert pad is positioned in one of the at least one first portion pocket or the at least one second portion pocket, the two or more second connector parts of the single piece insert pad are connected to the respective two or more first connector parts 22 of the first portion 12 or the two or more first connector parts 36 of the second portion 26.

In various embodiments, the at least one padded insert 40 includes two padded inserts, each of the two padded inserts comprising two or more second connector parts 42 spaced apart and located at an outer edge 52 of each of the two padded inserts, the first portion 12 and the second portion 26 comprising a corresponding number of the two or more first connector parts 22 and 36, respectively, to connect with the respective second connector parts 42 of the two padded inserts 40 when such padded inserts 40 are position in the at least one first portion pocket or the at least one second portion pocket. In embodiments where the first portion 12 and the second portion 26 define two pockets each as shown in FIG. 5, each pocket of the first portion 12 may contain at least two first connector parts 22, and each pocket of the second portion 26 may contain at least two first connector parts 36. In various embodiments, the two or more second connector parts 42 are on opposite sides of each of the two padded inserts.

In various embodiments, the at least one padded insert 40 may also comprise two or more arms 54 extending from the at least one padded insert 40, such as extending from the outer edge 52 of the at least one padded insert 40, each of the second connector parts 42 located at a distal end 56 of one of the two or more arms 54. In the embodiments shown in FIGS. 3 and 8, the at least one padded insert 40 is a single piece insert pad with two arms 54 extending from opposite sides of the single piece insert pad, and each of the two second connector parts 42 are located at the distal end 56 of each arm 54. Alternatively, in embodiments where the at least one padded insert 40 is two padded inserts, each of the two padded inserts may comprise two arms 54 extending from opposite sides of the respective padded insert, and each of the two second connector parts 42 are located at the distal end 56 of each arm 54.

The two-part connector may be any suitable connector as would be understood by a person of ordinary skill in the art that can assist in holding the at least one padded insert 40 in the at least one first portion pocket or the at least one second portion pocket. The two-part connector may be a hook and loop fastener, such as a swan fastener, or any other two part connector such as, for example, VELCRO®. For example, the two or more first connector parts 22 and 36 may be loops and the two or more second connector parts 42 may be hooks, or the two or more first connector parts 22 and 36 are hooks and the two or more second connector parts 42 are loops. Alternatively, the two-part connector may be a snap fastener. The two or more first connector parts 22 and 36 may be a female component of the snap fastener and the two or more second connector parts 42 may be a male component of the snap fastener, or the two or more first connector parts 22 and 36 may be a male component of the snap fastener and the two or more second connector parts 42 may be a female component of the snap fastener. The two-part connector may also be a hook and eye fastener, a button and loop fastener, a clasp and hook fastener, a buckle, a frog fastener, or any combination of the foregoing.

Figure 6:
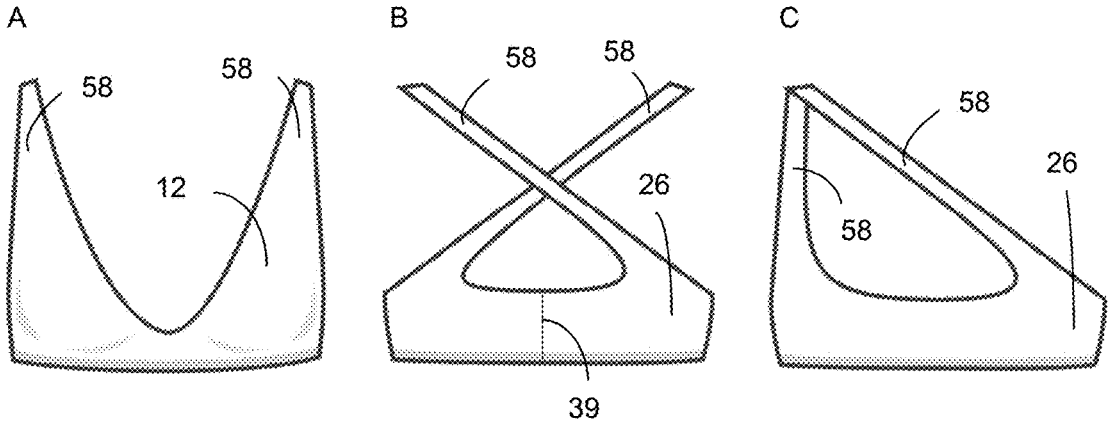
FIG. 6 is a front view of an outer layer of a first portion (A), a front view of an outer layer of a second portion (B), and a front view of the outer layer of the second portion of FIG. 5(B) with an alternative strap configuration, of a front to back reversible garment system according to an embodiment of the disclosure.

In various embodiments, the reversible garment system may further comprise one or more shoulder straps 58 connecting the first portion 12 and the second portion 26. Various designs for the shoulder straps 58 are within the scope of the disclosure, which may provide varying aesthetics. Different examples of shoulder straps 58 are shown in FIGS. 1 and 5-7. As shown in FIG. 6, the shoulder straps 58 may have different configurations where both shoulder straps 58 are positioned on one shoulder (FIG. 6C) or one strap per shoulder (FIG. 6B). In addition, the shoulder straps 58 may be position in a cross-over configuration as shown in FIGS. 5B, 5E and 6B.

In various embodiments, the reversible garment system may further comprise an underband 70 connected to a bottom edge 72 of the first portion 12 and a bottom edge 74 of the second portion 26, as shown in FIG. 4. The edges of the first portion 12 and the second portion 26 may also include any suitable elastic finishing or may be finished through bonding, such as, for example, ultrasonic bonding.

The reversible garment system may be any garment that covers at least a portion of the chest and at least a portion of the back of the wearer. For example, the reversible garment system may be a bra, a swimsuit or a tank top.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A back to front reversible garment system comprising:

a first portion comprising an outer layer, an inner layer, a first side and a second side, the outer layer and the inner layer defining at least one first portion pocket therebetween with at least one first portion pocket entrance opening, the first portion operably configured to cover at least a portion of a wearer's chest or to cover at least a portion of the wearer's back, and the first portion defining two arm-opening edges;

a second portion comprising an outer layer, an inner layer, a first side and a second side, the outer layer and the inner layer defining at least one second portion pocket therebetween with at least one second portion pocket entrance opening, the second portion operably configured to cover at least a portion of the wearer's chest or to cover at least a portion of the wearer's back, and the second portion defining two arm-opening edges, wherein the first side of the second portion is connected to the second side of the first portion, and the second side of the second portion is connected to the first side of the first portion; and at least one padded insert operably configured to be inserted through the at least one first portion pocket entrance opening and positioned in the at least one first portion pocket and to be inserted through the at least one second portion pocket entrance opening and positioned in the at least one second portion pocket, wherein in a first position when worn by the wearer, the first portion covers at least the portion of the wearer's chest and the second portion covers at least the portion of the wearer's back, and the at least one padded insert is positioned in the at least one first portion pocket, and wherein in a second position when worn by the wearer, the second portion covers at least the portion of the wearer's chest and the first portion covers at least the portion of the wearer's back, and the at least one padded insert is positioned in the at least one second portion pocket.

2. The back to front reversible garment system of claim 1, wherein the first portion further comprises two or more first connector parts of a two-part connector, the second portion further comprises two or more first connector parts of the two-part connector, and the at least one padded insert further comprises two or more second connector parts of the two-part connector, wherein in the first position when worn by the wearer, the two or more first connector parts of the first portion are connected to the respective two or more second connector parts of the at least one padded insert, and wherein in the second position when worn by the wearer, the two or more first connector parts of the second portion are connected to the respective two or more second connector parts of the at least one padded insert.

3. The back to front reversible garment system of claim 1, wherein the at least one first portion pocket entrance opening comprises first and second openings, the first opening proximate the first side of the first portion and the second opening proximate the second side of the first portion.

4. The back to front reversible garment system of claim 1, wherein the at least one second portion pocket entrance opening comprises first and second openings, the first opening proximate the first side of the second portion and the second opening proximate the second side of the second portion.

5. The back to front reversible garment system of claim 1, wherein the at least one first portion pocket entrance opening is formed at a part of a top edge of the first portion, and the at least one second portion pocket entrance opening is formed at a part of a top edge of the second portion.

6. The back to front reversible garment system of claim 1, wherein the at least one first portion pocket entrance opening is formed at one or both of the two arm-opening edges of the first portion, and the at least one second portion pocket entrance opening is formed at one or both of the two arm-opening edges of the second portion.

7. The back to front reversible garment system of claim 1, wherein the at least one padded insert is a single piece insert pad.

8. The back to front reversible garment system of claim 7, wherein the at least one first portion pocket is a single pocket and the at least one second portion pocket is a single pocket.

9. The back to front reversible garment system of claim 2, wherein the at least one padded insert is a single piece insert pad comprising two or more second connector parts spaced apart and located at an outer edge of the single piece insert pad, the two or more first connector parts of the two-part connector of the first portion and of the second portion are spaced apart and located in proximity to an outer margin of the respective at least one first portion pocket or the at least one second portion pocket such that when the single piece insert pad is positioned in one of the at least one first portion pocket or the at least one second portion pocket, the two or more second connector parts of the single piece insert pad are connected to the respective two or more first connector parts of the first portion or the second portion.

10. The back to front reversible garment system of claim 9, wherein the two or more second connector parts are on opposite sides of the single piece insert pad.

11. The back to front reversible garment system of claim 2, wherein the at least one padded insert is two padded inserts, each of the two padded inserts comprising two or more second connector parts spaced apart and located at an outer edge of each of the two padded inserts, the first portion and the second portion comprising a corresponding number of two or more first connector parts to connect with the respective second connector parts of the two padded inserts when such padded inserts are positioned in the at least one first portion pocket or the least one second portion pocket.

12. The back to front reversible garment system of claim 11, wherein the two or more second connector parts are on opposite sides of each of the two padded inserts.

13. The back to front reversible garment system of claim 11, wherein the at least one first portion pocket is two pockets and the at least one second portion pocket is two pockets.

14. The back to front reversible garment system of claim 2, further comprising two or more arms extending from the at least one padded insert, each of the second connector parts located at a distal end of one of the two or more arms.

15. The back to front reversible garment system of claim 2, wherein each of the first portion and the second portion comprise the same number of first connector parts as a total number of second connector parts on the at least one padded insert.

16. The back to front reversible garment system of claim 2, wherein the two-part connector is a hook and loop fastener, a hook and eye fastener, a snap fastener, a button and loop fastener, a clasp and hook fastener, a buckle, or a frog fastener.

17. The back to front reversible garment system of claim 2, wherein each of the two or more first connector parts of the first portion are adjacent to the two arm-opening edges of the first portion, and each of the two or more first connector parts of the second portion are adjacent to the two arm-opening edges of the second portion.

18. The back to front reversible garment system of claim 1, wherein a shape of the first portion is different from a shape of the second portion.

19. The back to front reversible garment system of claim 7, wherein a shape of the single piece insert pad comprises a reduced diameter at a center line of the single piece insert pad, and/or the shape of the single piece insert matches a breast profile shape of the wearer.

20. The back to front reversible garment system of claim 1, further comprising an underband connected to a bottom edge of the first portion and a bottom edge of the second portion.

* * * * *